US007632160B2

(12) United States Patent
Corry et al.

(10) Patent No.: US 7,632,160 B2
(45) Date of Patent: Dec. 15, 2009

(54) FOUR-WAY GROUND LUG

(75) Inventors: Charles D. Corry, Chicago, IL (US); Richard J. Stiles, Chicago, IL (US); Eugene L. Dimonte, Chicago, IL (US); Brian W. Matthews, Chicago, IL (US)

(73) Assignee: NA Communications, LLC, Chicago, IL (US)

( * ) Notice: Subject to any disclaimer, the term of this patent is extended or adjusted under 35 U.S.C. 154(b) by 35 days.

(21) Appl. No.: 12/027,180

(22) Filed: Feb. 6, 2008

(65) Prior Publication Data

US 2008/0188102 A1 Aug. 7, 2008

Related U.S. Application Data

(60) Provisional application No. 60/888,525, filed on Feb. 6, 2007.

(51) Int. Cl.
*H01R 4/36* (2006.01)

(52) U.S. Cl. ..... 439/814

(58) Field of Classification Search ..... 439/810–814, 439/817

See application file for complete search history.

(56) References Cited

U.S. PATENT DOCUMENTS 2,732,535 A * 1/1956 Hammerly ..... 439/814
3,344,394 A 9/1967 Kingsbury et al.
3,374,456 A * 3/1968 Evans ..... 439/224
3,638,173 A * 1/1972 Middendorf et al. ..... 439/814
4,401,357 A * 8/1983 Dvorachek et al. ..... 439/811
5,030,131 A * 7/1991 Boehm ..... 439/387
5,145,388 A 9/1992 Brownlie et al.
5,533,913 A * 7/1996 Boehm et al. ..... 439/810
5,674,079 A 10/1997 Auclair
5,842,891 A 12/1998 Rebers
5,957,733 A * 9/1999 Mello et al. ..... 439/814
5,978,208 A 11/1999 Helms et al.
6,213,818 B1 * 4/2001 Chadbourne ..... 439/810
6,242,697 B1 6/2001 Gerken et al.
6,400,235 B1 6/2002 Perez
6,572,418 B2 6/2003 Takaya et al.
6,725,524 B2 4/2004 Lin et al.

OTHER PUBLICATIONS

Notification of Transmittal of International Search Report and Written Opinion of the International Searching Authority, or the Declaration, International Search Report and Written Opinion of the International Searching Authority, all mailed Jul. 14, 2008.

* cited by examiner

*Primary Examiner*—Phuong K Dinh
(74) *Attorney, Agent, or Firm*—McGuireWoods LLP

(57) ABSTRACT

A ground lug for receiving an electrical wire from multiple directions to be secured within the ground lug, comprising a collar forming a receptacle for receiving an electrical wire, said collar including a first aperture for receiving a screw in an upper surface of the collar, and second and third apertures on first and second side surfaces, respectively, of the collar for receiving electrical wires within the receptacle, a threaded screw located within the first aperture for securing a wire within the receptacle when the threaded screw is tightened, and a tab extending from a lower surface of the collar, the tab including a forth aperture for receiving a screw to mount the ground lug to an electrical device.

22 Claims, 5 Drawing Sheets

50

FOUR-WAY GROUND LUG

CROSS REFERENCE TO RELATED APPLICATIONS

This application claims priority and the benefit under 35 U.S.C. 119(e) from U.S. Provisional Application Ser. No. 60/888,525, Filed Feb. 6, 2007 the disclosure of which are expressly incorporated by reference herein in its entirety

FIELD OF THE INVENTION

The present invention relates to generally to electrical hardwired assemblies and mountings, and more particularly, to an electrical grounding lug having both multiple electrical wire attachment ports providing access from multiple directions and multiple points on a hardwired assembly to affix the electrical grounding lug.

BACKGROUND OF THE PRESENT INVENTION

A ground lug is a mechanical device, usually a piece of formed copper sheet metal, with a clamping screw that is attached to a piece of electrical equipment. A typical purpose of the ground lug is to allow electrical equipment to be connected to an external wire that is electrically attached to earth-ground.

A problem with conventional ground lugs is they only have two entry ports, thus allowing only two directions for a wire to enter and be secured by the ground lug. This two-port limitation is problematic during installation because an earth-ground wire is typically large in size and supports a solid core wire, which is not easily routed in an intricate manner. Additionally, any bends that are made to the wire are potential failure areas, since the wire tends to crack fully or partially at the bend. If the wire cracks fully at the bend, there will be a loss of electrical continuity and the ground path will not be completed. If the wire partially cracks, and there is no indication of a loss of continuity, the reduced cross section of the wire will cause higher electrical resistance. As a result, the ground path is compromised in its ability to function, generally resulting in a failure to the electrical equipment that is was protecting.

OBJECTS AND SUMMARY OF THE INVENTION

In view of the foregoing, an object of the present invention is to provide enhanced flexibility, usability and overall functionality of electrical mounting assemblies.

Another object of the present invention is to provide a 4-way ground lug that accepts cable inputs from four different directions, not just two directions. This makes the 4-way ground lug of the present invention twice as flexible and user friendly as contemporary grounding lugs and methodologies.

A further object of the present invention is to provide hardwired assemblies or mounting boxes that support multiple location options for securing a ground lug. By providing various locations to mount the ground lug on a hardwired assembly or mounting box, a user can configure the ground lug to the needs of his specific application.

In order to achieve the above objects, the present invention provides a ground lug for receiving an electrical wire from multiple directions to be secured within the ground lug, said ground lug comprising a collar forming a receptacle for receiving an electrical wire, said collar including a first aperture for receiving a clamping screw in an upper surface of the collar, and second and third apertures on first and second side surfaces, respectively, of the collar for receiving electrical wires within the receptacle, a threaded clamping screw located within the first aperture for securing a wire within the receptacle when the threaded clamping screw is tightened, and a tab extending from a lower surface of the collar, the tab including a forth aperture for receiving a screw to mount the ground lug to an electrical device.

Other features and advantages of the present invention will become apparent to those skilled in the art from the following detailed description. It should be understood that the detailed description and specific examples, while indicating the preferred embodiment of the present invention, are given by way of illustration and not limitation. Many changes and modifications within the scope of the present invention may be made without departing from the spirit of the invention, and the invention includes all such modifications.

DESCRIPTION OF THE PREFERRED EMBODIMENTS

Figure 1:
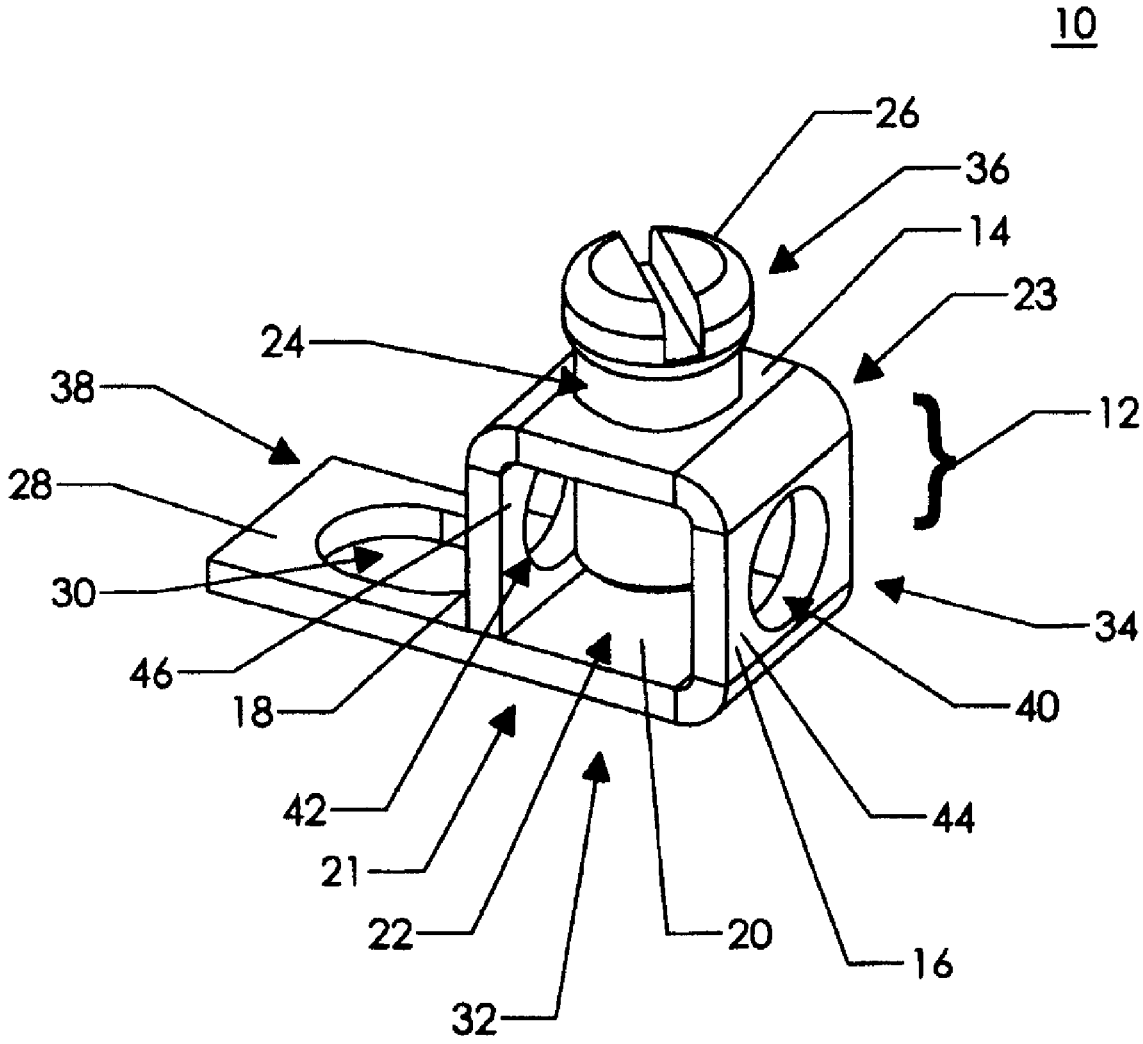
FIG. 1 is a perspective view of a ground lug configured in accordance with the present invention.

Turning now to the drawings, FIG. 1 illustrates a ground lug 10 configured in accordance with a first embodiment of the present invention. The ground lug 10 includes a collar 12 having an upper surface 14 and side surfaces 16 and 18. The collar also includes a lower surface 20. The collar 12 forms a receptacle 22 having openings 21 and 23 for receiving an electrical wire. Upper or top surface 14 of the collar 12 includes an aperture 24 for receiving a screw or bolt 26. In a preferred embodiment the screw 26 is a machine bolt, and the aperture 24 is threaded for receiving the machine bolt 26. Turning the machine bolt 26 in a clockwise manner to tighten the machine bolt 26 causes the machine bolt 26 to move towards the lower surface 20 of the collar 12 so as to secure an electrical wire within the receptacle 22.

The screw 26 functions as a fastener to secure a wire within the receptacle 22 of the collar 12. Other types of fasteners may be used to secure a wire within the collar 12. For example, a peg can be inserted through the aperture 24 to function as a fastener to secure a wire within the collar 12. A clamp can be used to secure a wire within the collar 12. Furthermore, a wedge can be used as a fastener to secure a wire within the collar 12 by driving the wedge into an opening 21,23 or aperture 24 of the collar 12 to secure the wire within the collar 12.

The ground lug 10 further includes a tab 28 attached to the collar having an aperture 30 located within the tab 28. In the illustrated embodiment, the tab 28 is formed out of the lower surface 20 of the collar 12 resulting in a unitary piece. The aperture 30 within the tab 28 is configured for receiving a screw to secure or mount the ground lug 10 to an electrical apparatus.

In accordance with the present invention, the ground lug 10 is configured to enable a user to insert a wire into the ground lug 10 from any of four directions 32, 34, 36, 38. To obtain this objective, the receptacle 22 includes openings 21,23 for receiving a wire in the direction 32 or 36. In a further aspect of the present invention, apertures 40 and 42 are included in the side surfaces 44 and 46, respectively. The apertures 40, 42 are configured to enable an electrical wire to be inserted from two additional directions 34 and 38 into the receptacle 22. In accordance with the present invention, the apertures 40 and 42 enable the ground lug 10 to receive an electrical wire or cable from two additional directions 34 and 38, which are perpendicular to the wire insertion directions 32 and 36 that are provided by openings 21 and 23 of the collar 12.

In this manner, the ground lug 10 enables an operator to have the choice of any of four wire insertion directions 32, 34, 36, 38 for securing an electrical wire or cable to the ground lug 10. These additional directions for securing an electrical wire to the ground lug 10 enables a user to avoid unnecessarily bending of a grounding wire or similar electrical connection, thus minimizing the chances for an electrical short circuit or disconnection.

The collar 12 and tab 28 of the ground lug 10 is constructed of electrically conductive material. In a preferred embodiment the collar 12 and tab 28 of the ground lug 10 are constructed from copper.

Figure 2A:
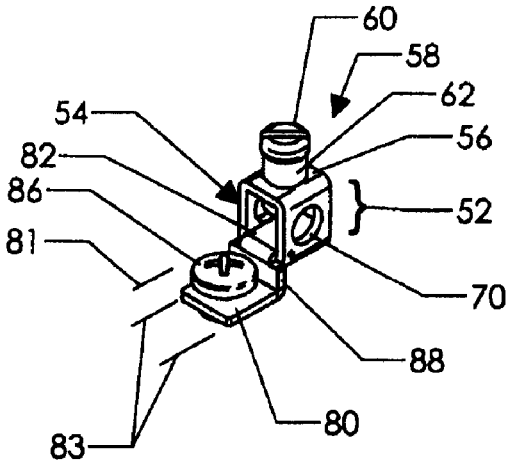
FIG. 2*a* is a perspective view of a ground lug configured in accordance with a second embodiment of the present invention.
Figure 2B:
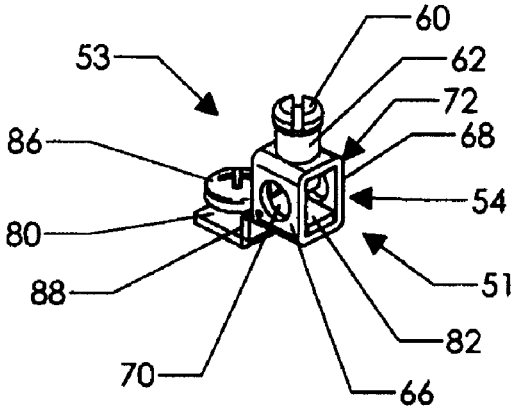
FIG. 2*b* is a different perspective view of the ground lug illustrated in FIG. 2*a;*
Figure 2B:
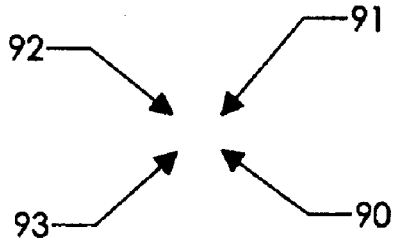
Figure 2C:
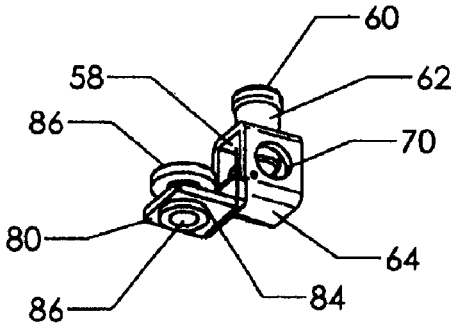
FIG. 2*c* is a different perspective view of the ground lug illustrated in FIGS. 2*a* and 2*b;*

Referring now to FIGS. 2*a* through 2*c*, an electrical fastener 50 is illustrated being configured in accordance with a second embodiment of the present invention. Electrical fastener 50 is illustrated having a collar 52 which forms a receptacle 54 for receiving an electrical wire. The upper surface 56 of the electrical fastener 50 includes an aperture 58 for receiving a machine bolt or screw 60. The upper surface 56 of the collar 52 includes an extended portion to form a throat 62 for housing the aperture 58. In a preferred embodiment, the aperture 58 is threaded to receive a compatibly threaded machine bolt or screw 60. By rotating the screw 60 in a clockwise rotation, the screw 60 moves downward towards a lower surface 64 of the collar 52 to secure a wire within the receptacle 54 of the electrical fastener 50

In accordance with the present invention, the collar 52 includes side surfaces 66 and 68 having apertures 70 and 72, respectively, for receiving an electrical wire within the receptacle 54. Similar to the first embodiment illustrated in FIG. 1, the electrical fastener 50 enables a user to insert an electrical wire into the receptacle 54 from any of four directions: either of two openings 51, 53 of the collar 52, or either of the two apertures 70, 72 in the side surfaces 66 or 68 of the collar 52. By enabling a user to have four different entry points for an electrical wire into the receptacle 54 of the electrical fastener 50, the user avoids having to bend the electrical wire in a difficult or adverse manner so as to avoid cracking or breaking the electrical wire while securing it within the receptacle 54 of the electrical fastener 50.

In accordance with a further object of the second embodiment illustrated in FIGS. 2*a*-2*c*, the electrical fastener 50 includes a tab 80 having a tongue 82 for inserting into the receptacle 54 of the collar 52. In contrast to the ground lug 10 illustrated in FIG. 1, the tab 80 and the collar 52 are separately formed elements. The tongue 82 of the tab 80 is inserted within the collar 52 and held in place within the receptacle 54 tightening the screw 60 to secure the tongue 82 against the lower surface 64 of the collar 52.

The tab 80 includes an aperture 84 for receiving a screw 86 for securing or mounting the electrical fastener 50 to an electrical component. In accordance with a further aspect of the electrical fastener 50, the tab 80 is located within a plane 83 located below a plane 81 created by the lower surface 64 of the collar 52. A step element 88 located between the tongue 82 and the aperture 84 of the tab 80 positions the aperture 84 within a lower plane 83 than the plane 81 created by the lower surface 64 of the collar 52. In this configuration, the receptacle 54 can receive an electrical wire from any of four wire insert directions (90, 91, 92, 93) while being positioned on a higher elevation or plane 81 than the plane 83 of tab 80 which is holding the receptacle 54 in position. In this manner, the electrical fastener 50 provides a user with even further easy access to the receptacle 54 by elevating the receptacle 54 above other components surrounding or close by the electrical fastener 50, thus facilitating insertion of an electrical wire within the receptacle 54.

Figure 3:
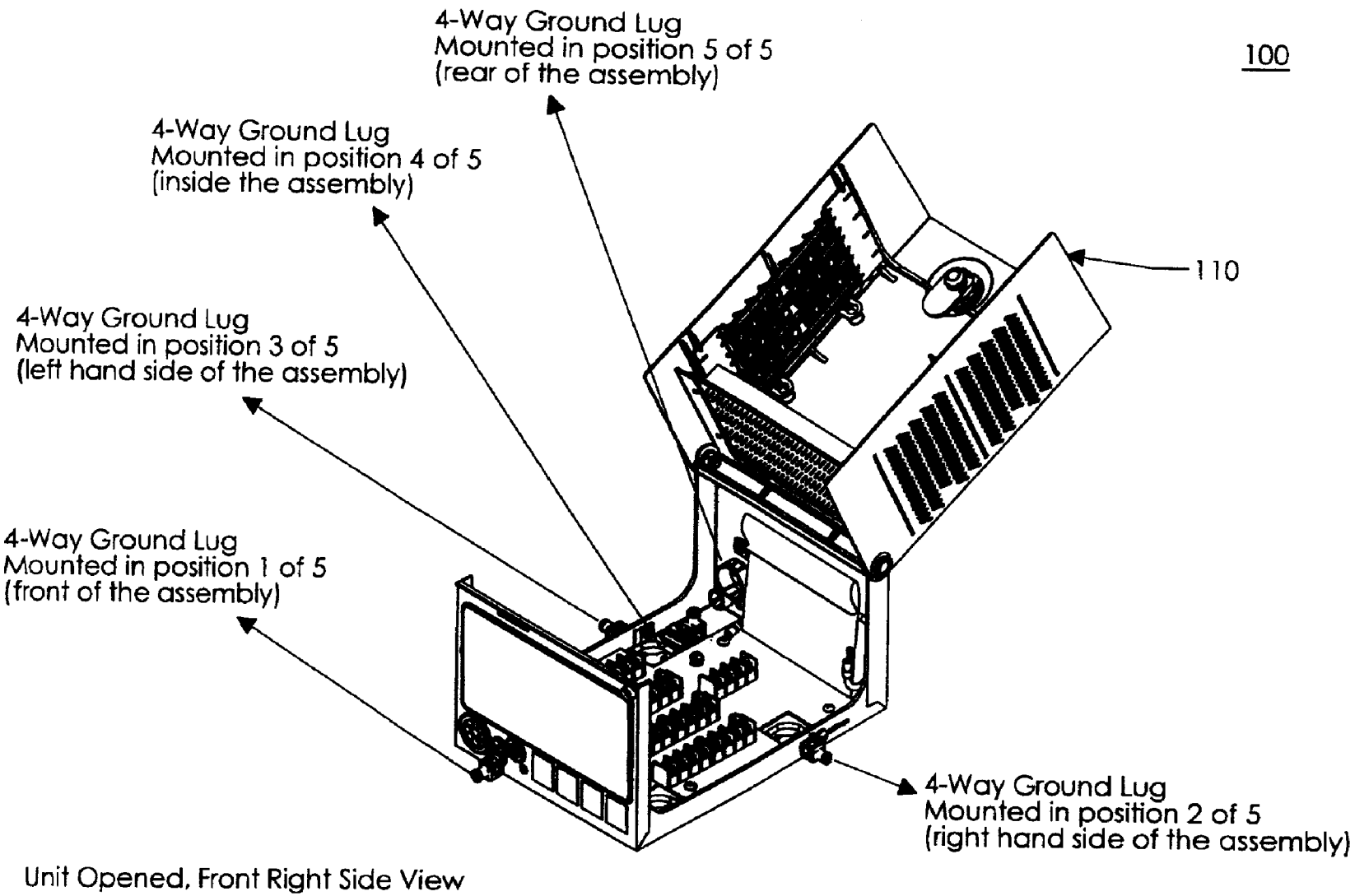
FIG. 3 is a perspective view of a hardwired mounting assembly in the open position and configured in accordance with the present invention showing five locations for mounting a ground lug.
Figure 4:
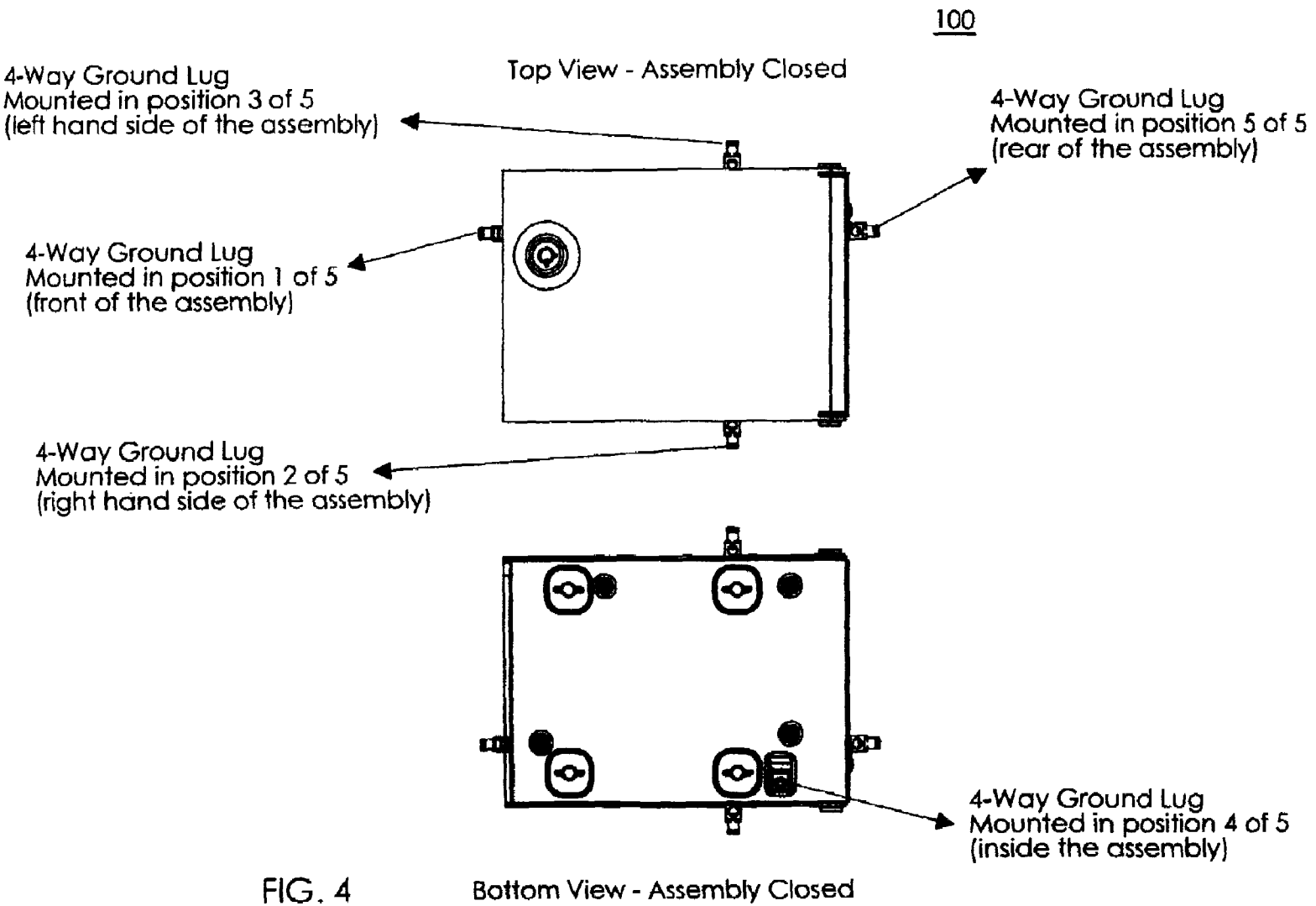
FIG. 4 shows top and bottom views of the hardwired mounting assembly shown in FIG. 3 in the closed position having multiple locations for mounting a ground lug.
Figure 5:
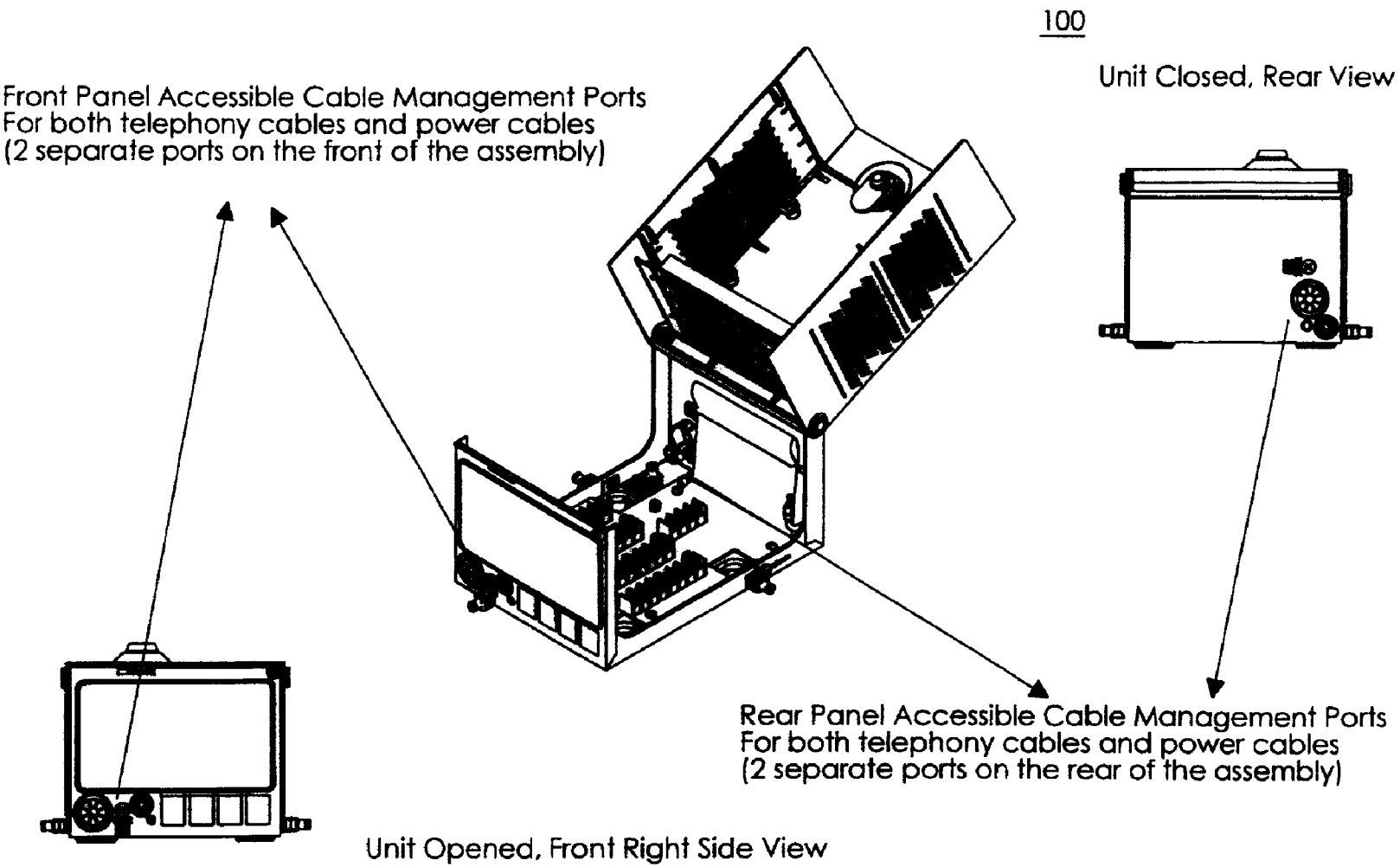
FIG. 5 shows perspective, front and rear views in both the open and closed positions of the hardwired mounting assembly shown in FIGS. 3 and 4.

FIGS. 3-5 illustrate a hardwired assembly or mounting box 100 configured in accordance with another feature of the present invention. The mounting box 100 includes a front surface (labeled mounting position 1 of 5), side surfaces (labeled mounting positions 2 of 5 and 3 of 5), a bottom surface (labeled mounting position 4 of 5), and a rear surface (labeled mounting position 5 of 5). The mounting box 100 includes a lid 110 rotatably mounted to the rear surface of the mounting box 100.

In accordance with the present invention and as illustrated in FIGS. 3-5, the mounting box includes multiple locations for mounting a ground lug, such as the 4-way ground lug of the present invention. In the preferred embodiment, the multiple mounting positions or locations for a ground lug include apertures in the front, rear, bottom, and side surfaces of the mounting box 100.

It should be understood that the above description of the present invention and preferred embodiment are given by way of description and illustration, and not limitation. Many changes and modifications within the scope of the present invention may be made without departing from the spirit of the present invention, and the present invention includes all such changes and modifications.

We claim as our invention:

1. A ground lug, comprising:

a collar forming a receptacle to receive a wire, the collar including a first aperture for receiving a screw in an upper surface of the collar;

a second aperture configured on a first side surface of the collar to receive the wire;

a tab extending from the collar, the tab including a third aperture to receive a mechanical fastener to secure the ground lug;

a fourth aperture configured on a second side of the collar to receive the wire; and the receptacle forming a first opening to receive the wire and forming a second opening to receive the wire, wherein the wire may be inserted into any one of: the second aperture, the fourth aperture, the first opening or the second opening to be secured by a screw in the first aperture, wherein the tab is constructed separately from the collar, and the tab includes a tongue for extending into and being secured within the receptacle by tightening the screw.

2. The ground lug of claim 1, wherein the mechanical fastener comprises a screw located within the first aperture for securing a wire within the receptacle when the screw is tightened and driven towards a lower surface of the collar.

3. The ground lug of claim 2, wherein the screw is a machine screw.

4. The ground lug of claim 1, wherein the tab is formed out of a lower surface of the collar.

5. The ground lug of claim 1, wherein the tab extends from a lower surface of the collar.

6. The ground lug of claim 1, wherein the third aperture within the tab is located in a plain below the plane of a lower surface of the collar.

7. The ground lug of claim 1, wherein the third aperture is threaded for receiving a screw.

8. The ground lug of claim 1, wherein the upper surface of the collar is formed to create a throat which extends above a plane created by the upper surface of the collar, and the throat includes the first aperture for receiving a screw.

9. The ground lug of claim 1, wherein the first aperture is threaded for receiving a screw.

10. The ground lug of claim 1, wherein the wire is an electrical wire or a ground wire.

11. The ground lug of claim 1, wherein the second aperture and fourth aperture are configured to receive the wire perpendicular to the tab extending from the collar.

12. An electrical fastener for receiving an electrical wire from multiple directions to be secured within the electrical fastener, said electrical fastening comprising:

a collar forming a receptacle to receive a wire, said collar including a first aperture to receive a mechanical fastener in an upper surface of the collar, and second and third apertures on first and second side surfaces, respectively, of the collar for receiving the wire within the receptacle;

the receptacle forming a first opening and a second opening, the openings configured to receive the wire;

the mechanical fastener located within the first aperture for securing a wire within the receptacle when the mechanical fastener is tightened and driven towards a lower surface of the collar; and a tab extending from the collar, the tab including a forth aperture for receiving a second mechanical fastener to mount the electrical fastener, wherein the tab and the collar are formed from separate components, and the tab includes a tongue which extends into and is secured within the receptacle by tightening the mechanical fastener.

13. The electrical fastener of claim 12, wherein the first aperture is threaded for receiving the mechanical fastener.

14. The electrical fastener of claim 12, wherein the electrical fastener is constructed of electrically conductive material.

15. The electrical fastener of claim 12, wherein the tab and the collar are formed from a single component.

16. The electrical fastener of claim 12, wherein the collar and tab are constructed of copper.

17. The electrical fastener of claim 12, wherein the upper surface of the collar is formed to create a throat which extends above a plane created by the upper surface of the collar, and the throat includes the first aperture for receiving the screw.

18. The electrical fastener claim 12, wherein the wire is an electrical wire or a ground wire.

19. A ground lug, comprising:

a collar forming a receptacle to receive an electrical wire, said collar including first and second apertures on first and second side surfaces, respectively, of the collar to receive an electrical wire in a direction perpendicular to an opening of the collar;

the receptacle configured to have a first opening and a second opening, each opening to receive an electrical wire;

a fastener to secure a wire within the receptacle of the collar; and a tab extending from the collar to mount the ground lug, wherein the tab is constructed separately from the collar, and the tab includes a tongue for extending into and being secured within the receptacle by tightening the fastener.

20. The ground lug of claim 19, wherein the tab includes an aperture for receiving a screw to mount the ground lug to an electrical device.

21. A ground lug, comprising:

means for receiving a wire from any of four directions into the ground lug so that each of the four directions is oriented perpendicular to another one of the four directions; and means for securing the receiving means to an electrical apparatus or structure, wherein the means for securing is constructed separately from the means for receiving and the means for securing extends into the means for receiving and is secured within the means for receiving by tightening a fastener in the means for securing.

22. The ground lug of claim 21, wherein the wire is an electrical wire or a ground wire.

* * * * *